US006758576B2

(12) United States Patent
Tsao

(10) Patent No.: US 6,758,576 B2
(45) Date of Patent: Jul. 6, 2004

(54) PORTABLE STACK LAMP

(76) Inventor: Frank Tsao, 5 Marram court, Cleveland, QLD 4163 (AU)

( * ) Notice: Subject to any disclaimer, the term of this patent is extended or adjusted under 35 U.S.C. 154(b) by 64 days.

(21) Appl. No.: 10/286,997

(22) Filed: Nov. 4, 2002

(65) Prior Publication Data

US 2004/0085763 A1 May 6, 2004

(51) Int. Cl.[7] ..... F21V 7/10

(52) U.S. Cl. ..... 362/216; 362/225; 362/226; 362/240; 362/260; 362/238; 362/239; 362/241; 362/249; 362/252; 362/257; 362/265; 362/227; 362/399; 362/486

(58) Field of Search ..... 362/216, 226, 362/225, 238, 239, 249, 257, 265, 227, 486, 399, 240, 260, 252

(56) References Cited

U.S. PATENT DOCUMENTS 2,435,715 A * 2/1948 Headings ..... 362/216
4,161,020 A * 7/1979 Miller ..... 362/216
6,398,384 B2 * 6/2002 Siminovitch et al. ..... 362/225
6,483,254 B2 * 11/2002 Vo et al. ..... 315/241 S

* cited by examiner

*Primary Examiner*—Sandra O'Shea
*Assistant Examiner*—Bertrand Zeade
(74) *Attorney, Agent, or Firm*—Raymond Y. Chan; David and Raymond Patent Group

(57) ABSTRACT

A portable stack lamp includes a base supported by a supporting device, such as an extensible tripod and a plurality of rolling wheels, two or more lamp units stacked up to form a stack-up lamp body mounted on said base, and a cover which is adapted to cover a top opening of the housing of the lamp unit having a handle affixed thereon. The portable stack lamp is arranged to provide 360 degrees illumination so as to produce luminous beams in all directions while the user is able to selectively increase or decrease its luminous intensity by simply stacking up more or less lamp unit easily anytime. Therefore, the portable stack lamp can illuminate the surrounding that not only minimizes the number of work lamps to be used but also saves both the electrical energy and illumination cost. Moreover, each of the lamp unit of the portable stack lamp is arranged to equip a ring type fluorescent bulb as a light source so that it can be used indoor while consuming less electrical energy than the incandescent bulb or halogen bulb of the conventional work lamp.

50 Claims, 7 Drawing Sheets

PORTABLE STACK LAMP

BACKGROUND OF THE PRESENT INVENTION

1. Field of Invention

The present invention relates to work lamps, and more particularly to a portable stack lamp which not only provides 360 degrees illumination but also is capable of being stacked up to increase lighting intensity.

2. Description of Related Arts

Table lamp, floor lamp, ceiling lamp, and etc. are common types of indoor lighting fixtures. Lantern lamp and spot light are outdoor lighting fixtures that generally use incandescent bulbs and halogen bulbs for illumination. Therefore, these outdoor lamps are most usually used as work lamps to provide supplemental illumination in working environments such as auto shops and factories.

Portability is the primary feature of a work lamp so that it is handy for the user to carry elsewhere for use. Therefore, both the lantern lamp and spot lamp are compact in size for easy carry from place to place. However, the user must hand carry the work lamp or hang it up near the workplace for illumination.

The luminous intensity of the conventional work lamp is limited to the power of light bulb. If a 60-watt incandescent bulb or halogen bulb is used in the lantern lamp or spot lamp, there is no way to increase or decrease the luminous intensity unless replacing the light bulb with one having a higher or lower watt.

Since reflection disc is generally mounted behind the light bulb of the convention work lamp to reflect light beam to enhance luminous intensity, either the lantern lamp or the spot lamp can only emit luminous beam in a single direction that may limit the work lamp's application and require the user to rotate the entire work lamp by hand to direct the light beam to the area where the user wants to illuminate.

Due to the safety concern that the halogen work lamp produces great amount of heat during illumination, it not only wastes energy but also renders the halogen work lamp not being allowed to be used indoor.

SUMMARY OF THE PRESENT INVENTION

It is a main object of the present invention to provide a portable stack lamp which is arranged to provide 360 degrees illumination so as to produce luminous beams in all directions. Therefore, one portable stack lamp can illuminate the surrounding that not only minimizes the number of work lamps to be used but also saves both the electrical energy and illumination cost.

It is another object of the present invention to provide a portable stack lamp which arrangement successfully equips a ring type fluorescent bulb as the light source in each lamp unit so that it can be used indoor while consuming less electrical energy than the incandescent bulb or halogen bulb of the conventional work lamp.

It is another object of the present invention to provide a portable stack lamp wherein the circular central lamp mount which is used to support the ring type fluorescent bulb therearound is used, at the same time, as a reflective ring to reflect all light beams radially outwards.

It is another object of the present invention to provide a portable stack lamp which enables the user to selectively increase or decrease its luminous intensity by simply stacking up more or less lamp unit easily anytime.

It is another object of the present invention to provide a portable stack lamp which fluorescent bulb is arranged to be easily reached and replaced, wherein the user has no need to detach all upper lamp units one by one and merely requires to unassemble the lamp unit attached on top of the lamp unit to be repaired in order to reach the fluorescent bulb therein.

It is another object of the present invention to provide a portable stack lamp which can stand on floor, support at an adjustable height and is easy to carry and roll from place to place effortlessly.

In order to accomplish the above objects, the present invention provides a portable stack lamp, comprising:

a base having a top mounting surface and a bottom supporting surface;

means for supporting the base being detachably attached to the bottom supporting surface of the base;

at least a lamp unit which comprises:

a housing which is a circular disc having a bottom wall and a surrounding wall made of transparent material;

a ring-shaped lamp mount, which is attached to a central portion of the bottom wall of the housing, having a circular outer light reflective surface and defining a receiving chamber therein and a light source chamber between the light reflective surface and the surrounding wall of the housing;

a ring type fluorescent bulb having a diameter smaller than the housing and larger than the lamp mount and a height smaller than the surrounding wall of the housing;

means for mounting the fluorescent bulb around the lamp mount inside the light source chamber of the housing;

a control circuit, which is disposed in the receiving chamber, comprising a power connector detachably connected to the fluorescent bulb, a power input terminal for electrically connecting to a power source to supply electricity to the fluorescent bulb, and a power output terminal for extended electrical connection;

a bottom attachment fastener provided at a bottom portion of the housing; and a top attachment fastener provided at a top portion of the housing; and a cover adapted to cover a top opening of the housing of the lamp unit;

wherein when only one lamp unit is used, the bottom attachment fastener thereof is attached to the top mounting surface of the base and the top attachment fastener is attached to the cover;

in which when two more lamp units are used, the bottom attachment fastener of the bottom layer of lamp unit is attached to the top mounting surface of the base and the bottom attachment fastener of an upper layer of lamp unit is detachably fastened to the top attachment fastener of the lower neighboring layer of lamp unit so as to stack up the lamp units in a layer on layer manner, wherein the cover is attached to the top attachment fastener of the topmost layer of lamp unit to construct the portable stack lamp of the present invention.

DETAILED DESCRIPTION OF THE PREFERRED EMBODIMENT

Figure 1:
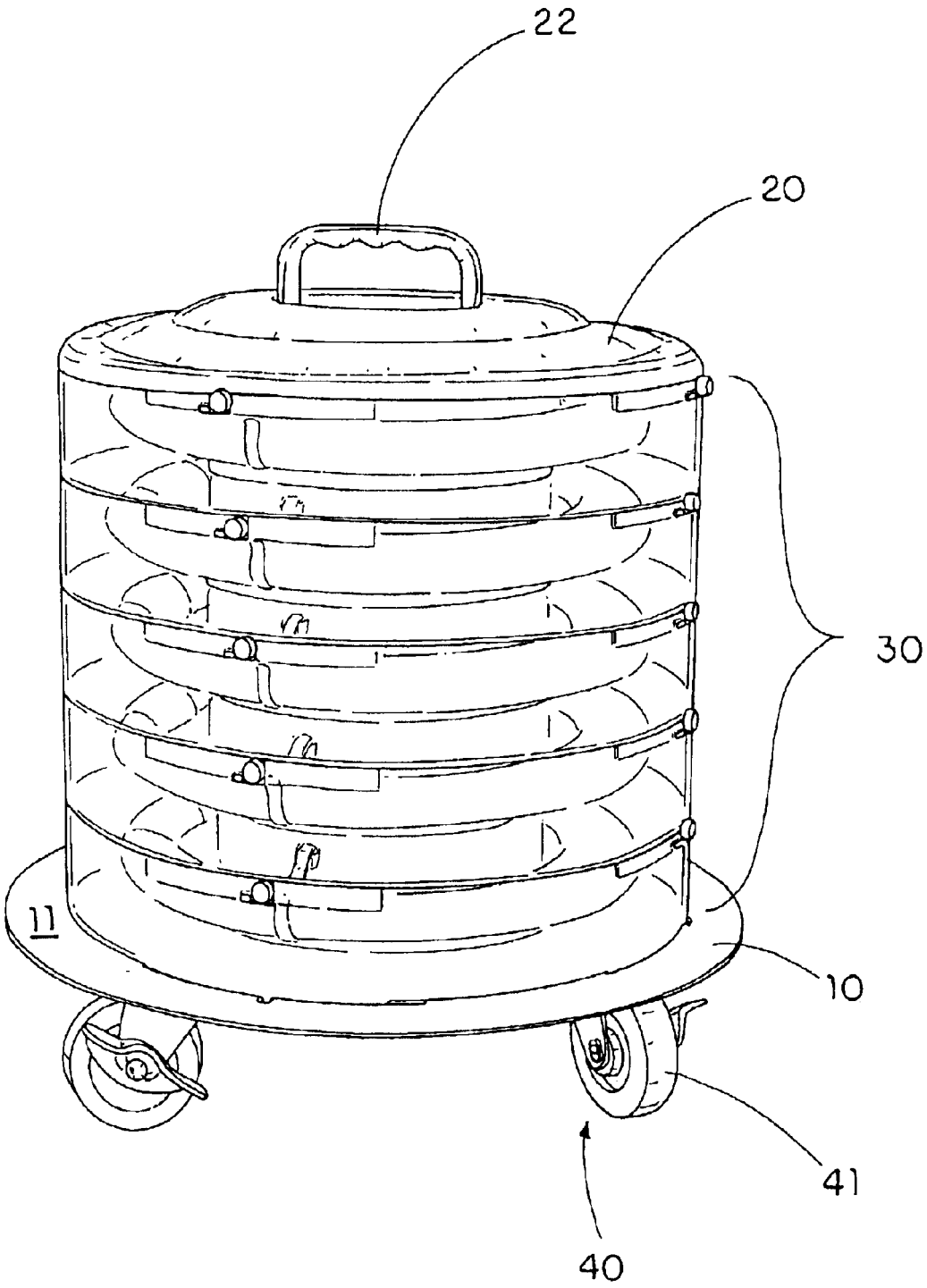
FIG. 1 is a perspective view of a portable stack lamp according to a preferred embodiment of the present invention.

Referring to FIGS. 1 to 7, a portable stack lamp according to a preferred embodiment of the present invention is illustrated, which comprises a base 10, a cover 20 and one or more layers of lamp unit 30 mounted between the base 10 and the cover 20.

As shown in FIGS. 1, 2, 4, and 6, the base 10 has a top mounting surface 11 and a bottom supporting surface 12. The base 10 further provides with a base attachment fastener 13 which includes a plurality of arc-shape attachment slots 131 circularly and spacedly aligned on the base 10. Each of the attachment slots 131 has an indention 132 formed along a middle portion of an outer elongated side thereof. The base 10 further comprises an elongaged electric cord 14 having one end connected with a terminal connector 141, which is extended to mount on the top mounting surface 11 of the base, and another end connected with an electric plug 142 for connecting to a power supply.

Figure 2:
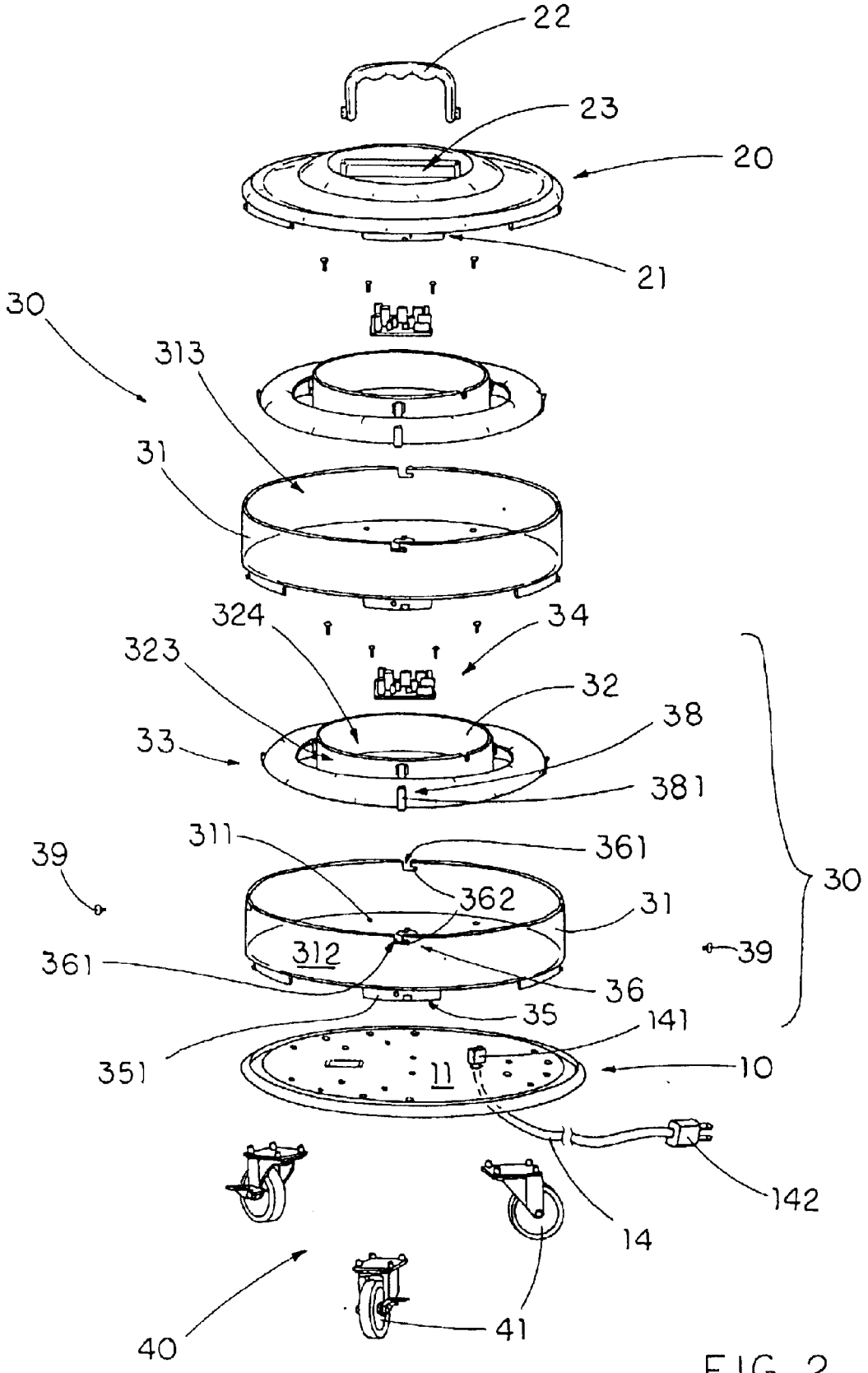
FIG. 2 is an exploded perspective view of the portable stack lamp according to the above preferred embodiment of the present invention.
Figure 4:
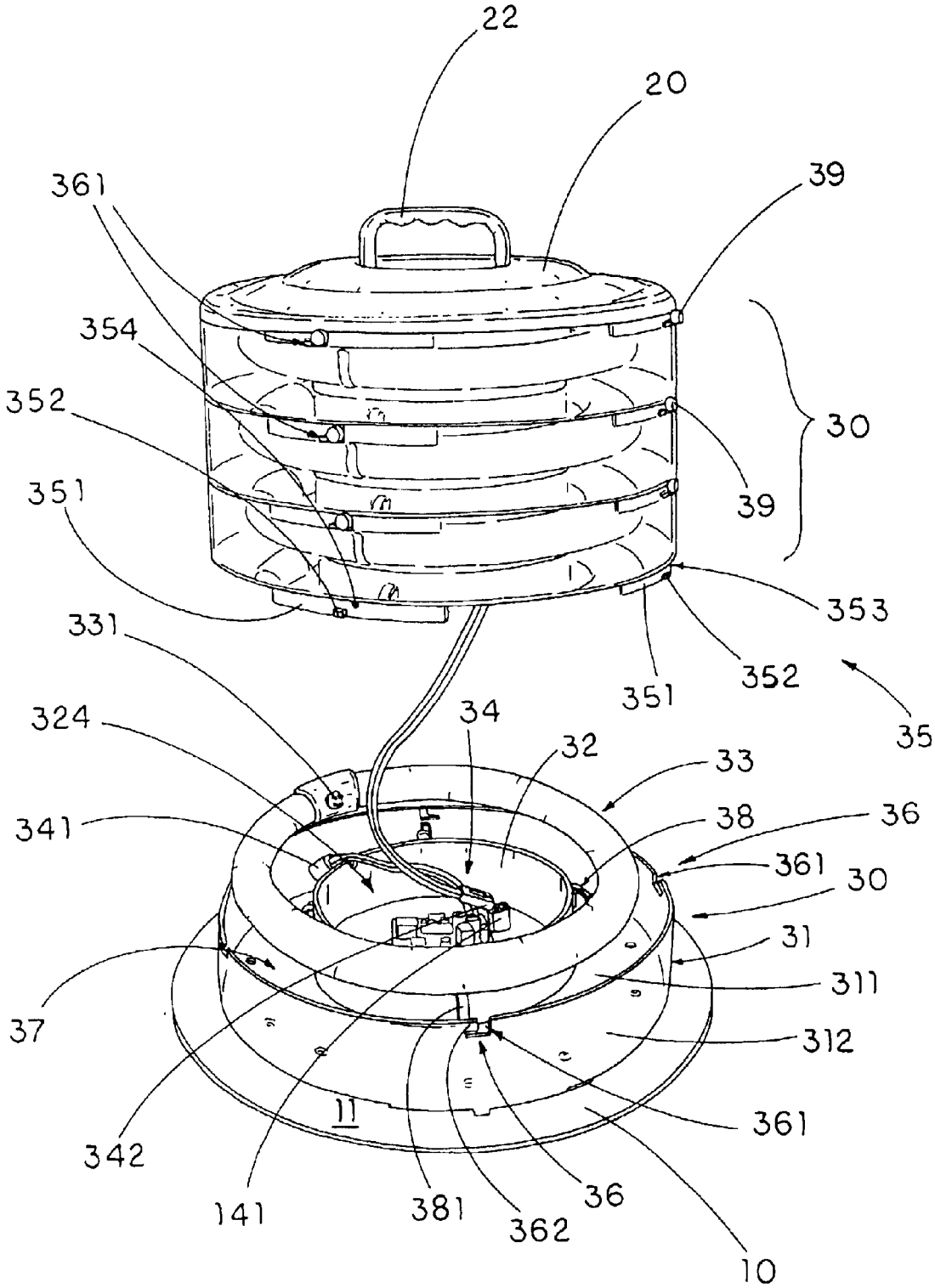
FIG. 4 is a perspective view of the portable stack lamp illustrating how to replace the fluorescent bulb of a bottom layer of lamp unit according to the above preferred embodiment of the present invention.
Figure 5:
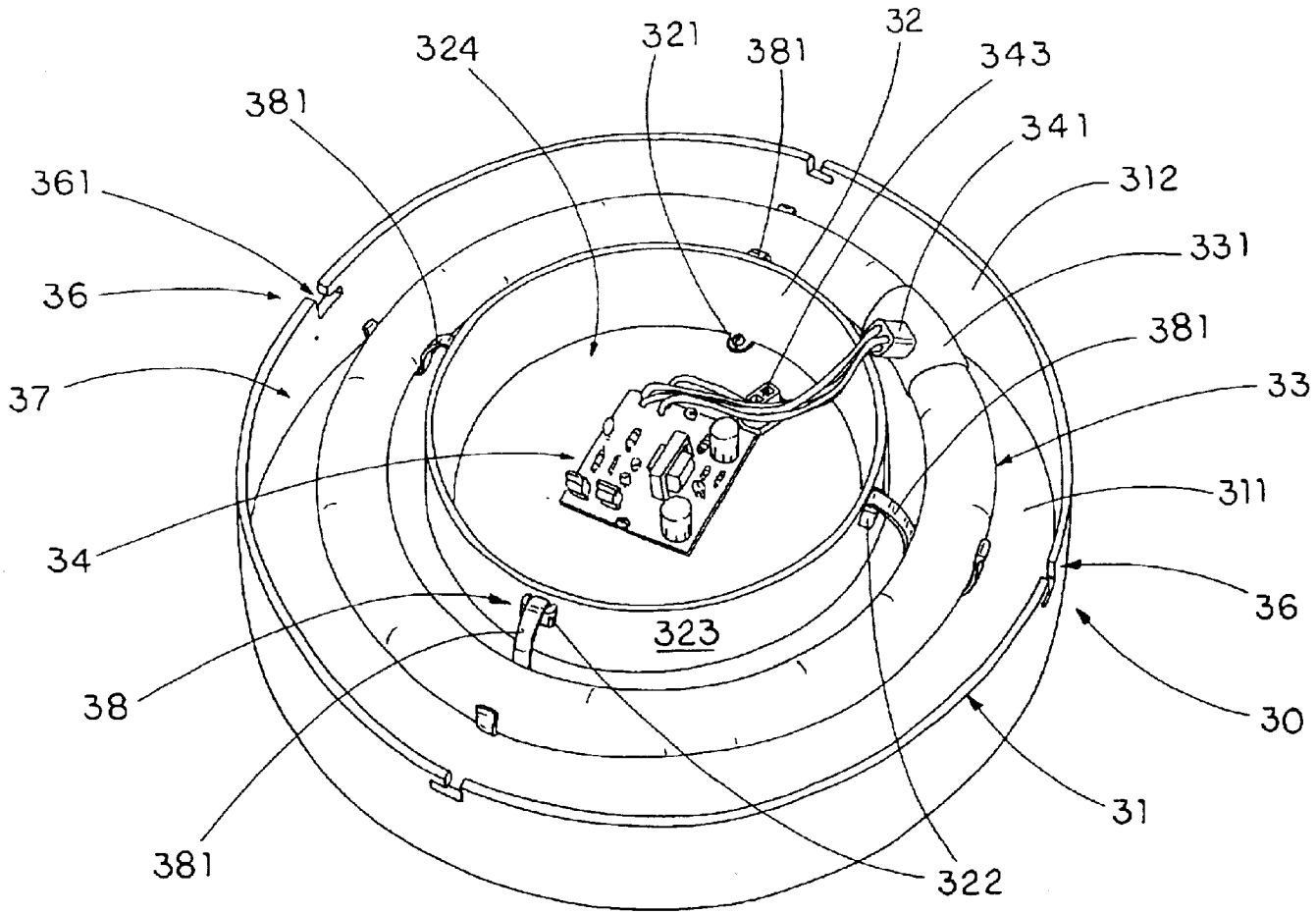
FIG. 5 is top perspective view of the lamp unit of the portable stack lamp according to the above preferred embodiment of the present invention.

Referring to FIGS. 2, 4 and 5, each of the lamp units 30 comprises a housing 31, a ring-shaped lamp mount 32, a light source 33, a control circuit 34, a bottom attachment fastener 35, and a top attachment fastener 36.

The housing 31, which is a plastic made transparent circular disc having a U-shaped cross section, has a bottom wall 311 and a surrounding wall 312. The lamp mount 32 is a ring-shaped body which bottom end inwardly protruded a plurality of fastening lips 321 for fastening on a central portion of the bottom wall 311 of the housing 31 by screws so as to integrally and coaxially fasten the lamp mount 32 on the bottom wall 311. The lamp mount 32 further comprises a plurality of holder heads 322 integrally and spacedly protruded on an upper portion of the outer peripheral surface of the lamp mount 32. The lamp mount 32 has a circular outer light reflective surface 323 and defines a receiving chamber 324 therein and a light source chamber 37 between the light reflective surface 323 and the surrounding wall 312 of the housing 31.

The lamp unit 30 further comprises a mounting device 38 for supporting the light source 33 around the lamp mount 32 inside the light source chamber 37 of the housing 31, so that the light beams emitted from the light source around the lamp mount 32 illuminate all directions through the surrounding wall 312 while the reflective surface 323 ensures all light beams being radially directed outwards.

According to the preferred embodiment of the present invention, the light source 33 is embodied as a ring type fluorescent bulb having a diameter smaller than the housing 31 and larger than the lamp mount 32 and a height smaller than the surrounding wall 312 of the housing 31. The mounting device 38 includes a plurality of U-shaped holder mounts 381 having one end connected to the holder heads 322 respectively. Therefore, the ring type fluorescent bulb 33 is supported by sitting on the holder mounts 381 and the U-shaped holder mounts 381 are fittingly clipped on the body of the fluorescent bulb 33 spacedly so as to evenly support the weight of the fluorescent bulb 33 within the light source chamber 37. Accordingly, the ring type fluorescent bulb 33 is extended around the housing 31 and emits luminous beams outside in 360 degrees through circular surrounding wall 312. At the same time, the luminous beams emits inwardly from the inner peripheral edge of the fluorescent bulb 33 are all reflected radially outwards by the reflective surface 323 of the lamp mount 32.

The control circuit 34 is disposed in the receiving chamber 324 and mounted on the bottom wall 311 of the housing for controlling the power supply and illumination of the fluorescent bulb 33. The control circuit 34 of the preferred embodiment should include a power connector 341 detachably connected to a power input terminal 331 to supply power for the light source 33, a power input terminal 342 for electrically connecting with the power source to supply electricity (as shown in FIG. 4), and a power output terminal 343 for providing an electrical connection with another lamp unit 30 (if any) of the stack lamp of the present invention (as shown in FIG. 5). For fluorescent bulb, the power connector 341 should include a starter to light up the fluorescent bulb 33.

As shown in FIGS. 2 and 4, the bottom attachment fastener 35 of each of the lamp units 30 is provided at a bottom portion of the housing 31 thereof. The bottom attachment fastener 35 includes a plurality of arc-shaped attachment ribs 351 integrally and downwardly protruded from the bottom wall 311 of the housing 31. The arc-shaped attachment ribs 351 are spacedly aligned along a peripheral edge of the bottom wall. On each of the attachment ribs 351, an engagement knob 352 is protruded from a middle portion of the outer surface thereof that defines an engagement gap 353 between the engagement knob 352 and the bottom edge of the surrounding wall 312. In addition, a threaded hole 353 is formed adjacent to the engagement gap 353 on each of the attachment ribs 351.

Figure 6:
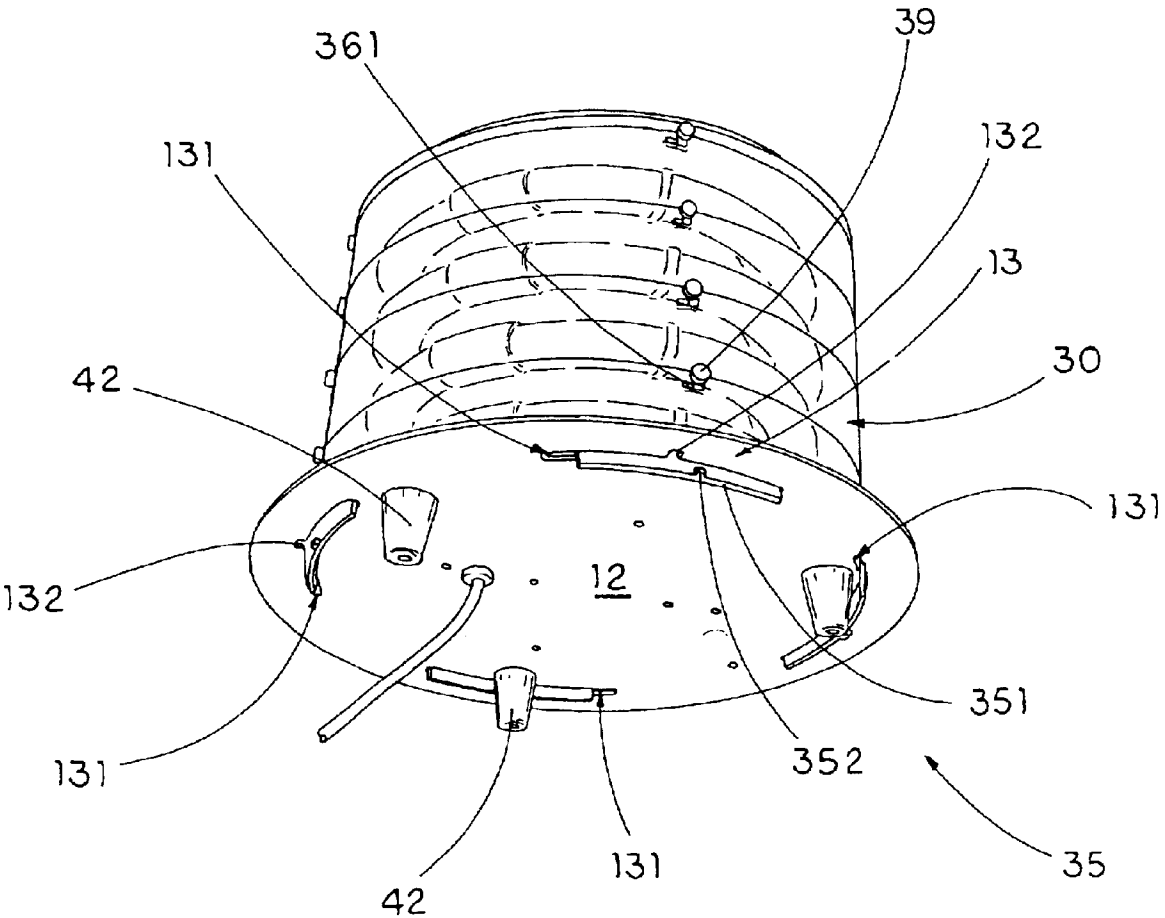
FIG. 6 is a bottom perspective view of the portable stack lamp according to the above preferred embodiment of the present invention, wherein the rolling wheels are replaced with floor stands.

As shown in FIG. 6, in order to mount a lamp unit 30 on the base 10 to function as bottom layer of lamp unit 30, the user may simply insert the arc-shaped attachment ribs 351 of the lamp unit 30 through the arc-shaped attachment slots 131 respectively while aligning the engagement knobs 352 with the indentions 132, wherein the length of the attachment slot 131 should be longer than that of the attachment rib 351. After the engagement knobs 352 pass through the attachment slots 131, the user can simply rotate the lamp unit 30 until the engagement knobs 352 are disaligned with the indentions 132 so as to engage the base 10 between the bottom wall 311 of the lamp unit 31 and the attachment knobs 352. Of course, other connection methods, such as screwing, clipping and gluing, can be used to connect the lamp unit 30 to the base 10. It is also worth to mention that, when the bottom wall 311 of the lamp unit 30 is constructed strong and rigid enough, the bottom wall 311 can be functioned as the base 10 of the stack lamp of the present invention too.

As shown in FIGS. 2 and 4, the top attachment fastener 36 of each of the lamp units 30 is provided at a top portion of the housing 31 thereof. The top attachment fastener 36 has a plurality of L-shaped engagement slots 361 formed on a top side of the surrounding wall 312 of the housing 31. Each of the engagement slots 361 has a vertical portion downwardly extended from a top edge of the surrounding wall 312 and a transversal portion horizontally extended from a bottom of the vertical portion on the surrounding wall 312 of the housing, so as to define an edge tongue 362 above the transversal portion of the respective engagement slot 361, wherein the width of the engagement slot 361 is equal to or slightly smaller than a size of the engagement knob 352.

Therefore, in order to stack up a lamp unit 30 on top of another one coaxially, the user merely needs to overlappedly stack an upper lamp unit 30 on another lower lamp unit 30 while aligning the engagement knobs 352 with the engagement slots 361 respectively. The distance between two opposing attachment ribs 351 should be arranged to be slightly smaller than an inner diameter of the top rim of the surrounding wall 312, so that the attachment ribs 351 can be inserted in the light source chamber 37. Then, when the top edge of the surrounding wall 312 of the lower lamp unit 30 supports against the bottom wall 311 of the upper lamp unit 30, the engagement knobs 352 are positioned at the bottom end of the vertical portions of the engagement slots 361 respectively. To lock the connection, the user merely needs to rotate the upper lamp unit 30 with respect to the lower lamp unit 30 to transversally drive the engagement knobs 352 into the transversal portions of the engagement slots 361 so that the edge tongues 362 of the top attachment fastener 36 of the lower lamp unit 30 are engaged between the engagement knobs 352 and the bottom wall 311 of the upper lamp unit 30 while the threaded holes 353 of the attachment ribs 351 are aligned at the vertical portions of the engagement slots 361 respectively. Therefore, in order to enhance the connection between the upper and lower lamp units 30, a plurality of fastening screws 39 each having an enlarged head is screwed into the threaded holes 353 until the enlarged heads are pressed against the surrounding wall 312 of the lower lamp unit 30 so as to further fasten the attachment ribs 351 of the upper lamp unit 30 with the surrounding wall 312 of the lower lamp unit 30.

In order words, the lamp units 30 can thus be stacked up in a layer on layer manner to form a stack-up lamp body. It is worth that it would be an apparent alternative mode to replace the arrangements of the bottom attachment fastener 35 and the top attachment fastener 36 with each other.

Figure 3:
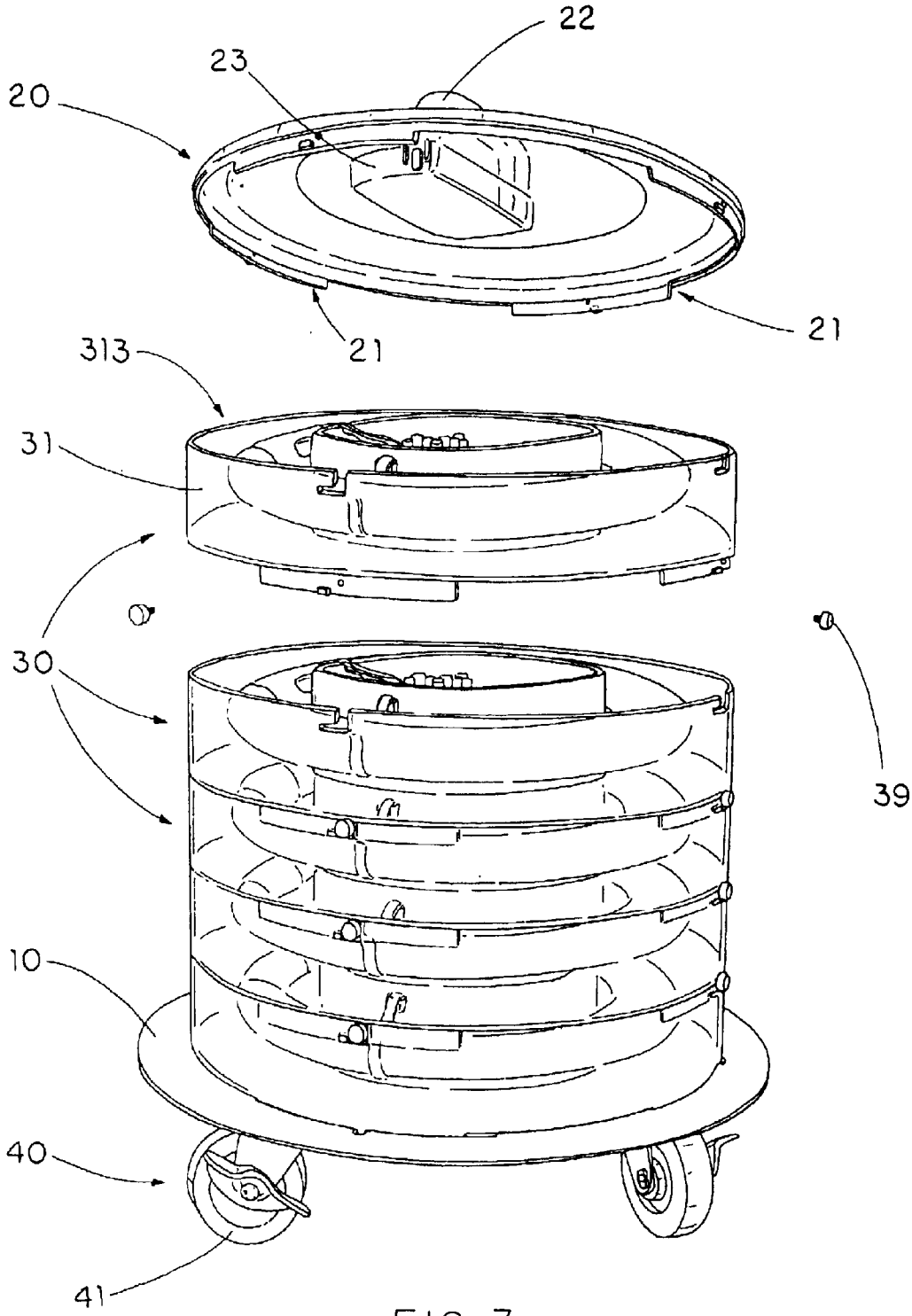
FIG. 3 is a perspective view of the portable stack lamp illustrating the top layer of lamp unit and the cover separately according to the above preferred embodiment of the present invention.

As shown in FIGS. 2 and 3, the cover 20 is adapted to cover a top opening 313 of the housing 31 of the topmost lamp unit 30. According to the preferred embodiment of the present invention, the cover 20 also comprises a cover attachment fastener 21 which is constructed identical to the bottom attachment fastener 35 of each of the lamp unit 30, so that the cover attachment fastener 21 can be fastened with the top attachment fastener 36 of any of the lamp units 30 like how the bottom attachment fastener 35 of the upper lamp unit 30 is connected with the top attachment fastener 36 of the lower lamp unit 30 as described above.

The cover 20 is preferred to further include a handle 22 pivotally affixed thereon for the user to hand carry the stack lamp from place to place. A handle recess 23 is formed on the cover 20 to receive the handle 22 when it is folded down.

When only one lamp unit 30 is used, the bottom attachment fastener 35 thereof is attached to the top mounting surface 11 of the base 10 as described above and the top attachment fastener 36 is connected to the cover attachment fastener 21 of the cover 20.

When two more lamp units 30 are used, as shown in FIGS. 1 to 5, the bottom attachment fastener 35 of the bottom layer of lamp unit 30 is mounted on the top mounting surface 11 of the base 10 and the bottom attachment fastener 35 of an upper layer of lamp unit 30 is detachably fastened to the top attachment fastener 36 of the lower neighboring layer of lamp unit 30 so as to stack up the lamp units 30 in a layer on layer manner, wherein the cover 20 is attached to the top attachment fastener 36 of the topmost layer of lamp unit 30 to construct the portable stack lamp of the present invention as shown in FIG. 1.

In view of above, the portable stack lamp of the present invention is arranged to enable a ring type fluorescent bulb 33 to be equipped as the light source in each lamp unit so that it can be used indoor while consuming less electrical energy than the incandescent bulb or halogen bulb of the conventional work lamp. Moreover, the circular central lamp mount which is used to support the ring type fluorescent bulb therearound is used, at the same time, as a reflective ring to reflect all light beams radially outwards.

All lamp units 30 have the same structure, so that the user is free to select the number of lamp units 30 to purchase. When the user needs more luminous intensity, the user can simply stack more lamp units 30 up. When the user wants to reduce the luminous intensity, the user can detach the desired number of lamp units 30 easily anytime.

When the fluorescent bulb 33 of any lamp unit 30 is broken, the user has no need to detach all upper lamp units one by one. The user of the present invention merely needs to unassemble the lamp unit 30 attached on top of the lamp unit 30 to be repaired in order to reach the fluorescent bulb 33 therein, as shown in FIG. 4.

The portable stack lamp of the present invention further comprises a supporting device 40 for supporting the base 10, which is detachably attached to the bottom supporting surface 12 of the base 10. Referring to FIGS. 1 to 5, for ease of transportation, the supporting device 40 includes a plurality of rolling wheels 41 affixed to the bottom supporting surface 12 of the base 10 so that the user can roll it from place to place effortless.

As shown in FIG. 6, the rolling wheels 41 can be replaced with floor stands 42 which are firmly screwed to the bottom supporting surface 12 of the base 10 to steadily support the portable stack lamp on a slippery surface.

Figure 7:
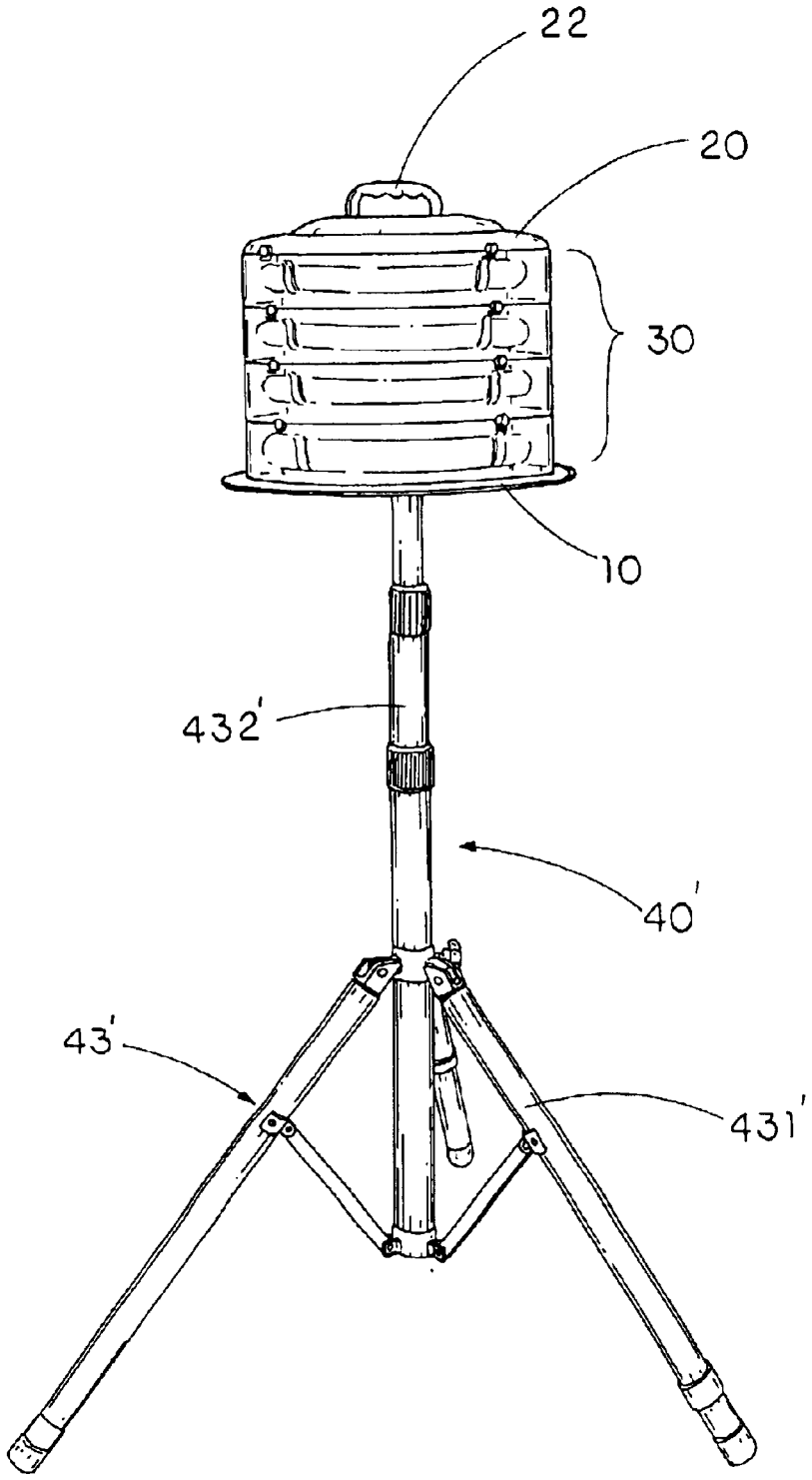
FIG. 7 is a perspective of the portable stack lamp according to an alternative mode of the above preferred embodiment of the present invention.

As shown in FIG. 7, an alternative mode of the supporting device 40' is illustrated, which includes an extensible tripod 43' to stand the portable stack lamp on floor. The tripod 43' comprises a foldable tripod base 431' and an extensible post 432' upwardly extended from the foldable tripod base 431', wherein a top end of the extensible post 432' is detachably fastened to the bottom supporting surface 12 of the base 10, so that the user is capable of adjusting the illuminating height of the portable stack lamp.

What is claimed is:

1. A stack lamp, comprising:

two or more lamp units, each comprising:

a housing which is a circular disc having a bottom wall and a surrounding wall made of transparent material;

a ring-shaped lamp mount, which is supported on a central portion of said bottom wall of said housing, having a circular outer light reflective surface and defining a receiving chamber therein and a light source chamber between said light reflective surface and said surrounding wall of said housing;

a light source which is disposed inside said light source chamber of said housing and supported around said reflective surface of said lamp mount;

a control circuit, which is disposed in said receiving chamber, comprising a power connector detachably connected to said light source, a power input terminal for supplying electricity to said light source via said power connector, and a power output terminal for extended electrical connection;

a bottom attachment fastener provided at a bottom portion of said housing; and a top attachment fastener provided at a top portion of said housing;

wherein said top attachment fastener of a lower layer of said lamp units is detachably fastened with said bottom attachment fastener of an upper layer of said lamp units while said power output terminal of said lower layer of said lamp units is connected with said power input terminal of said upper layer of said lamp units, so as to stack up said lamp units in a layer on layer manner to form a stack-up lamp body;

a base having a top mounting surface and a bottom supporting surface;

means for mounting said stack-up lamp body on said base;

means for supporting said base being detachably attached to said bottom supporting surface of said base; and an elongaged electric cord having one end connected with an electric plug and another end provided with a terminal connector to electrically connect with said power input terminal of said lamp unit that is attached to said base.

2. The stack lamp, as recited in claim 1, wherein said light source includes a ring type fluorescent bulb having a diameter smaller than said housing and larger than said lamp mount and a height smaller than said surrounding wall of said housing.

3. The stack lamp, as recited in claim 2, wherein each of said lamp unit further comprises means for mounting said fluorescent bulb around said lamp mount inside said light source chamber of said housing.

4. The stack lamp, as recited in claim 3, wherein said lamp mount is a ring-shaped body which bottom end inwardly protruded a plurality of fastening lips for fastening on said central portion of said bottom wall of said housing so as to integrally and coaxially fasten said lamp mount on said bottom wall.

5. The stack lamp, as recited in claim 3, wherein each of said lamp units further comprises a mounting device for supporting said fluorescent bulb around said lamp mount inside said light source chamber of said housing, wherein said mounting device includes a plurality of U-shaped holder mounts each having one end connected to said lamp mount, wherein said fluorescent bulb is supported by sitting on said holder mounts spacedly so as to evenly support a weight of said fluorescent bulb within said light source chamber.

6. The stack lamp, as recited in claim 1, wherein said bottom attachment fastener of each of said lamp units includes a plurality of arc-shaped attachment ribs, which are integrally and downwardly protruded from said bottom wall of said housing and spacedly aligned along a peripheral edge of said bottom wall, and a plurality of engagement knobs protruded from outer surfaces of said attachment ribs respectively that defines an engagement gap between each of said engagement knobs and a bottom edge of said surrounding wall, wherein said top attachment fastener of each of said lamp units has a plurality of engagement slots formed on a top edge of said surrounding wall of said housing, wherein to connect said bottom attachment fastener of one of said lamp unit with said top attachment fastener of another of said lamp units, said engagement knobs are engaged with said engagement slots respectively.

7. The stack lamp, as recited claim 6, wherein each of said engagement slots has a first portion downwardly extended from said top edge of said surrounding wall and a second portion transversally extended from said first portion that defines an edge tongue between said top edge of said surrounding wall and said second portion of each of said engagement slots, wherein said attachment ribs are inserted in said light source chamber until said top edge of said surrounding wall of said lower lamp unit supports against said bottom wall of said upper lamp unit and said engagement knobs are positioned at bottom ends of said first portions of said engagement slots respectively, thereafter said engagement knobs are driven transversally into said second portions of said engagement slots so that said edge tongues of said top attachment fastener are engaged between said engagement knobs and said bottom wall of said upper lamp unit.

8. The stack lamp, as recited in claim 6, wherein a threaded hole is formed adjacent to said engagement gap on each of said attachment ribs and a plurality of fastening screws each having an enlarged head is screwed into said threaded holes until said enlarged heads are pressed against said surrounding wall of said respective lamp unit.

9. The stack lamp, as recited in claim 7, wherein a threaded hole is formed adjacent to said engagement gap on each of said attachment ribs and a plurality of fastening screws each having an enlarged head is screwed into said threaded holes until said enlarged heads are pressed against said surrounding wall of said respective lamp unit.

10. The stack lamp, as recited in claim 6, wherein said means for mounting said stack-up lamp body on said base includes a base attachment fastener which has a plurality of arc-shape base attachment slots circularly and spacedly aligned on said base for said attachment ribs to insert therethrough.

11. The stack lamp, as recited in claim 10, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

12. The stack lamp, as recited in claim 7, wherein said means for mounting said stack-up lamp body on said base includes a base attachment fastener which has a plurality of arc-shape base attachment slots circularly and spacedly aligned on said base for said attachment ribs to insert therethrough.

13. The stack lamp, as recited in claim 12, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

14. The stack lamp, as recited in claim 8, wherein said means for mounting said stack-up lamp body on said base includes a base attachment fastener which has a plurality of arc-shape base attachment slots circularly and spacedly aligned on said base for said attachment ribs to insert therethrough.

15. The stack lamp, as recited in claim 14, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

16. The stack lamp, as recited in claim 9, wherein said means for mounting said stack-up lamp body on said base includes a base attachment fastener which has a plurality of arc-shape base attachment slots circularly and spacedly aligned on said base for said attachment ribs to insert therethrough.

17. The stack lamp, as recited in claim 16, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

18. The stack lamp, as recited in claim 3, wherein said bottom attachment fastener of each of said lamp units includes a plurality of arc-shaped attachment ribs, which are integrally and downwardly protruded from said bottom wall of said housing and spacedly aligned along a peripheral edge of said bottom wall, and a plurality of engagement knobs protruded from outer surfaces of said attachment ribs respectively that defines an engagement gap between each of said engagement knobs and a bottom edge of said surrounding wall, wherein said top attachment fastener of each of said lamp units has a plurality of engagement slots formed on a top edge of said surrounding wall of said housing, wherein to connect said bottom attachment fastener of one of said lamp unit with said top attachment fastener of another of said lamp units, said engagement knobs are engaged with said engagement slots respectively.

19. The stack lamp, as recited claim 18, wherein each of said engagement slots has a first portion downwardly extended from said top edge of said surrounding wall and a second portion transversally extended from said first portion that defines an edge tongue between said top edge of said surrounding wall and said second portion of each of said engagement slots, wherein said attachment ribs are inserted in said light source chamber until said top edge of said surrounding wall of said lower lamp unit supports against said bottom wall of said upper lamp unit and said engagement knobs are positioned at bottom ends of said first portions of said engagement slots respectively, thereafter said engagement knobs are driven transversally into said second portions of said engagement slots so that said edge tongues of said top attachment fastener are engaged between said engagement knobs and said bottom wall of said upper lamp unit.

20. The stack lamp, as recited in claim 19, wherein a threaded hole is formed adjacent to said engagement gap on each of said attachment ribs and a plurality of fastening screws each having an enlarged head is screwed into said threaded holes until said enlarged heads are pressed against said surrounding wall of said respective lamp unit.

21. The stack lamp, as recited in claim 19, wherein said means for mounting said stack-up lamp body on said base includes a base attachment fastener which has a plurality of arc-shape base attachment slots circularly and spacedly aligned on said base for said attachment ribs to insert therethrough.

22. The stack lamp, as recited in claim 21, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

23. The stack lamp, as recited in claim 20, wherein said means for mounting said stack-up lamp body on said base includes a base attachment fastener which has a plurality of arc-shape base attachment slots circularly and spacedly aligned on said base for said attachment ribs to insert therethrough.

24. The stack lamp, as recited in claim 23, wherein said means for mounting said stack-up lamp body further has a plurality of indentions formed at outer elongated sides of said base attachment slots respectively, wherein in order to mount said stack a lamp unit on said base to function as a bottom layer of said lamp units, said arc-shaped attachment ribs of said respective lamp unit are inserted through said base attachment slots respectively while aligning said engagement knobs with said indentions, wherein a length of each of said attachment slots is longer than that of said attachment rib, wherein after said engagement knobs pass through said base attachment slots, said respective lamp unit is rotated until said engagement knobs are disaligned with said indentions so as to engage said base between said bottom wall of said respective lamp unit and said attachment knobs.

25. The stack lamp, as recited in claim 1, further comprising a cover to cover a top opening of said stack-up lamp body.

26. The stack lamp, as recited in claim 25, wherein a handle is affixed to said cover.

27. The stack lamp, as recited in claim 26, wherein said handle is pivotally affixed on said cover and a handle recess is formed on said cover to receive said handle when it is folded down.

28. The stack lamp, as recited in claim 26, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

29. The stack lamp, as recited in claim 3, further comprising a cover to cover a top opening of said stack-up lamp body.

30. The stack lamp, as recited in claim 29, wherein a handle is affixed to said cover.

31. The stack lamp, as recited in claim 7, further comprising a cover to cover a top opening of said stack-up lamp body, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

32. The stack lamp, as recited in claim 31, wherein a handle is affixed to said cover.

33. The stack lamp, as recited in claim 9, further comprising a cover to cover a top opening of said stack-up lamp body, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

34. The stack lamp, as recited in claim 33, wherein a handle is affixed to said cover.

35. The stack lamp, as recited in claim 11, further comprising a cover to cover a top opening of said stack-up lamp body, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

36. The stack lamp, as recited in claim 35, wherein a handle is affixed to said cover.

37. The stack lamp, as recited in claim 17, further comprising a cover to cover a top opening of said stack-up lamp body, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

38. The stack lamp, as recited in claim 37, wherein a handle is affixed to said cover.

39. The stack lamp, as recited in claim 24, further comprising a cover to cover a top opening of said stack-up lamp body, wherein said cover comprises a cover attachment fastener which includes a plurality of arc-shaped cover attachment ribs for engaging with said top attachment fastener of said lamp unit that is positioned at a top layer of said stack-up lamp body, wherein cover attachment ribs are integrally and downwardly protruded from said cover and spacedly aligned along a peripheral edge of said cover, and a plurality of cover engagement knobs protruded from outer surfaces of said cover attachment ribs respectively that defines an cover engagement gap between each of said cover engagement knobs and said cover.

40. The stack lamp, as recited in claim 39, wherein a handle is affixed to said cover.

41. The stack lamp, as recited in claim 1, wherein said supporting means includes a plurality of rolling wheels affixed to said bottom supporting surface of said base.

42. The stack lamp, as recited in claim 1, wherein said supporting means includes an extensible tripod affixed to said bottom supporting surface of said base.

43. The stack lamp, as recited in claim 3, wherein said supporting means includes a plurality of rolling wheels affixed to said bottom supporting surface of said base.

44. The stack lamp, as recited in claim 3, wherein said supporting means includes an extensible tripod affixed to said bottom supporting surface of said base.

45. The stack lamp, as recited in claim 7, wherein said supporting means includes a plurality of rolling wheels affixed to said bottom supporting surface of said base.

46. The stack lamp, as recited in claim 7, wherein said supporting means includes an extensible tripod affixed to said bottom supporting surface of said base.

47. The stack lamp, as recited in claim 17, wherein said supporting means includes a plurality of rolling wheels affixed to said bottom supporting surface of said base.

48. The stack lamp, as recited in claim 17, wherein said supporting means includes an extensible tripod affixed to said bottom supporting surface of said base.

49. The stack lamp, as recited in claim 38, wherein said supporting means includes a plurality of rolling wheels affixed to said bottom supporting surface of said base.

50. The stack lamp, as recited in claim 38, wherein said supporting means includes an extensible tripod affixed to said bottom supporting surface of said base.

* * * * *